US006664884B1

(12) United States Patent
Yu

(10) Patent No.: US 6,664,884 B1
(45) Date of Patent: Dec. 16, 2003

(54) DUAL-CIRCUIT SWITCH STRUCTURE WITH OVERLOAD PROTECTION

(76) Inventor: Tsung-Mou Yu, No. 4, Alley 2, Lane 23, Sec. 3, Pa Te Road, Panchiao City, Taipei Hsien (TW)

( * ) Notice: Subject to any disclaimer, the term of this patent is extended or adjusted under 35 U.S.C. 154(b) by 0 days.

(21) Appl. No.: 10/228,342

(22) Filed: Aug. 24, 2002

(51) Int. Cl.[7] ..... H01H 71/58; H01H 71/16

(52) U.S. Cl. ..... 337/59; 337/56; 337/91; 200/622

(58) Field of Search ..... 337/56, 59, 60, 337/68, 79, 91; 200/622

(56) References Cited

U.S. PATENT DOCUMENTS 3,435,169 A * 3/1969 Wolfgang et al. ..... 200/315
3,735,077 A * 5/1973 Ohashi ..... 200/315
4,013,857 A * 3/1977 Tanaka ..... 200/315
4,115,673 A * 9/1978 Smith ..... 200/315
4,337,450 A * 6/1982 Matthies ..... 337/66
4,345,233 A * 8/1982 Matthies ..... 337/75
4,736,081 A * 4/1988 Sorrells ..... 200/525
4,904,833 A * 2/1990 Sato et al. ..... 200/557
5,453,725 A * 9/1995 You et al. ..... 337/68
5,541,569 A * 7/1996 Jang ..... 337/68
6,252,490 B1 * 6/2001 Lin ..... 337/79
6,275,134 B1 * 8/2001 Chen ..... 337/37
6,570,480 B1 * 5/2003 Huang ..... 337/79

* cited by examiner

*Primary Examiner*—Anatoly Vortman

(57) ABSTRACT

A switch includes a casing inside which two electrically isolated circuits are arranged. Each circuit includes first and second conductive blades fixed inside the casing. A conductive strip made of a material that bends when subject to a temperature rise is fixed to the first blade and has a free end. A conductive plate is arranged inside the casing and in electrical connection with the second blade and movable between an engaged position where the conductive plate engages the free end of the conductive strip to form an electrical connection between the first and second blades and a disengaged position where the conductive plate disengages from the conductive strip to electrically disconnect the second blade from the first blade. When an overload occurs, an excessive current flows through the conductive strips, causing the strips to bend from a normal operation condition to a breaking condition that separates the conductive strip from the conductive plate. A coupler made of insulation material is coupled between the conductive strips to ensure both conductive strips move to the breaking condition at the same time. A leaf spring is pivoted between the casing and one of the conductive strips to retain the conductive strips in the breaking condition until the conductive strip is manually forced to the normal operation condition to ensure operation reliability. The leaf spring is pivotally connected to the casing via a bolt that allows for adjustment of the leaf spring with respect to the conductive strip.

20 Claims, 11 Drawing Sheets

DUAL-CIRCUIT SWITCH STRUCTURE WITH OVERLOAD PROTECTION

FIELD OF THE INVENTION

The present invention relates generally to a switch, and in particular to a dual-circuit switch having an overload protection mechanism for operation safety.

BACKGROUND OF THE INVENTION

A switch is operable between an ON (connected) state and an OFF (disconnected) state for control of power supply or electrical signal transmission. For a power switch, overheating and burning caused by overload resulting from undesired shorting is one of the major concerns of operation safety. Some switches available in the market are provided with safety mechanism that automatically cuts off power supplied therethrough in order to eliminate the potential risk of overheating and burning. Such switches, however, have complicated structures, making costs high and manufacture difficult.

The electricity system of some areas, such as Europe, is a dual-circuit system comprised of two electrical circuits individually and independently supplying power to an electric appliance. With the conventional overload protection mechanism, when an overload occurs, it is very likely that only one of the two circuits is open while the other one still maintains the electrical supply. This leads to some disadvantages:

(1) Since the power supplied through the switch is maintained by the circuit that is not broken by the overload protection mechanism, risk caused by overloading of the electrical appliance to which the power is supplied cannot be properly controlled.

(2) Operators that intend to resume supply of electricity by release the overload protection mechanism may be electrically shocked if the circuit that is still maintained is not cut off first.

(3) If the circuit that is open due to overload is not timely resumed its operation condition, power supplied to the electrical appliance through the switch may not be sufficient to properly operate the electrical appliance and thus causing undesired problems.

It is thus desirable to have a dual-circuit switch structure having an overload protection mechanism that overcomes the above problems.

SUMMARY OF THE INVENTION

An object of the present invention is to provide a dual-circuit switch comprising an overload protection mechanism that operates to opens both circuits simultaneously in order to completely cut off power supplied through the switch.

Another object of the present invention is to provide a dual-circuit switch comprising an overload protection mechanism that ensures operation reliability in cutting off power supplied through the switch and eliminates incorrect operation caused by material fatigue.

A further object of the present invention is to provide a dual-circuit switch comprising an overload protection mechanism that can be adjusted to provide best response of the overload protection mechanism.

To achieve the above objects, in accordance with the present invention, there is provided a switch comprising a casing inside which two electrically isolated circuits are arranged. Each circuit comprises first and second conductive blades fixed inside the casing. A conductive strip made of a material that bends when subject to a temperature rise is fixed to the first blade and has a free end. A conductive plate is arranged inside the casing and in electrical connection with the second blade and movable between an engaged position where the conductive plate engages the free end of the conductive strip to form an electrical connection between the first and second blades and a disengaged position where the conductive plate disengages from the conductive strip to electrically disconnect the second blade from the first blade. When an overload occurs, an excessive current flows through the conductive strips, causing the strips to bend from a normal operation condition to a breaking condition that separates the conductive strip from the conductive plate. A coupler made of insulation material is coupled between the conductive strips to ensure both conductive strips move to the breaking condition at the same time. A leaf spring is pivoted between the casing and one of the conductive strips to retain the conductive strips in the breaking condition until the conductive strip is manually forced to the normal operation condition to ensure operation reliability. The leaf spring is pivotally connected to the casing via a bolt that allows for adjustment of the leaf spring with respect to the conductive strip.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE INVENTION

Figure 1:
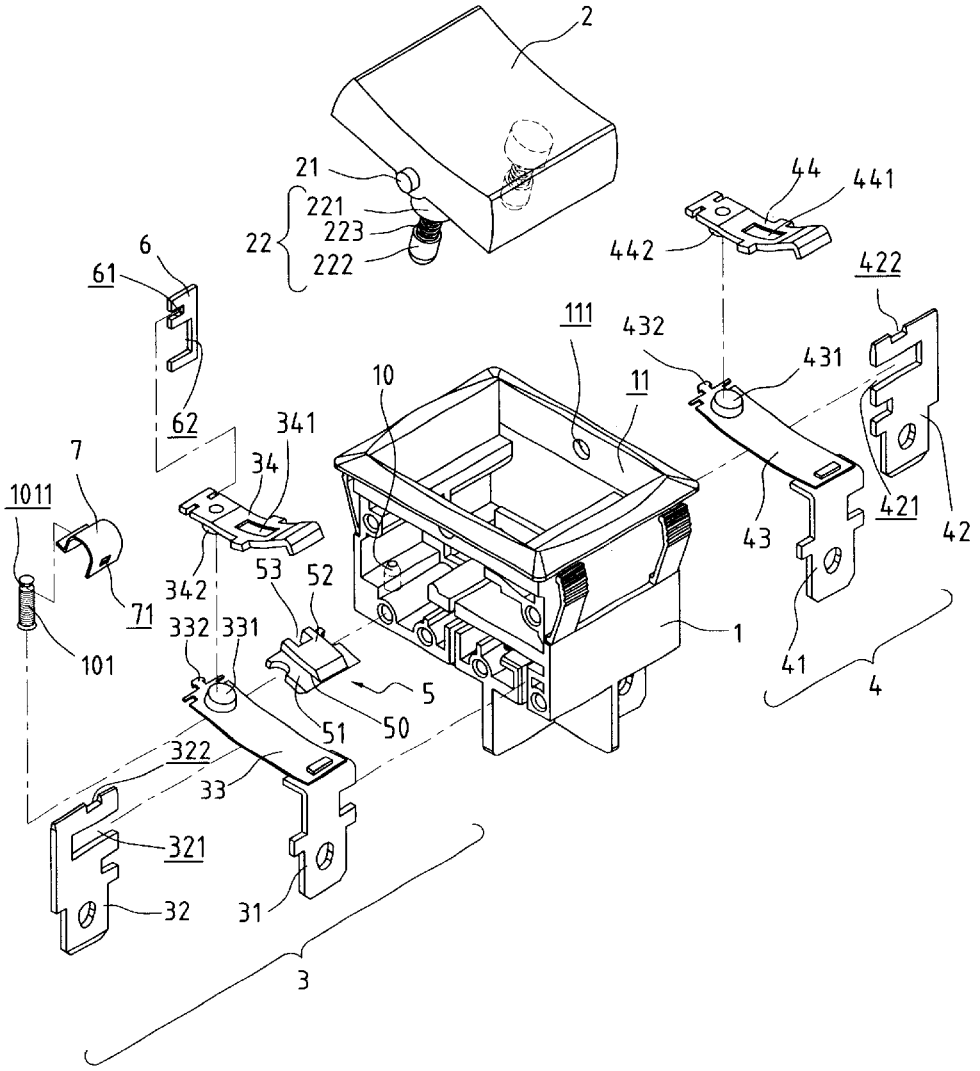
FIG. 1 is an exploded perspective view of a dual-circuit switch constructed in accordance with a first embodiment of the present invention.
Figure 2:
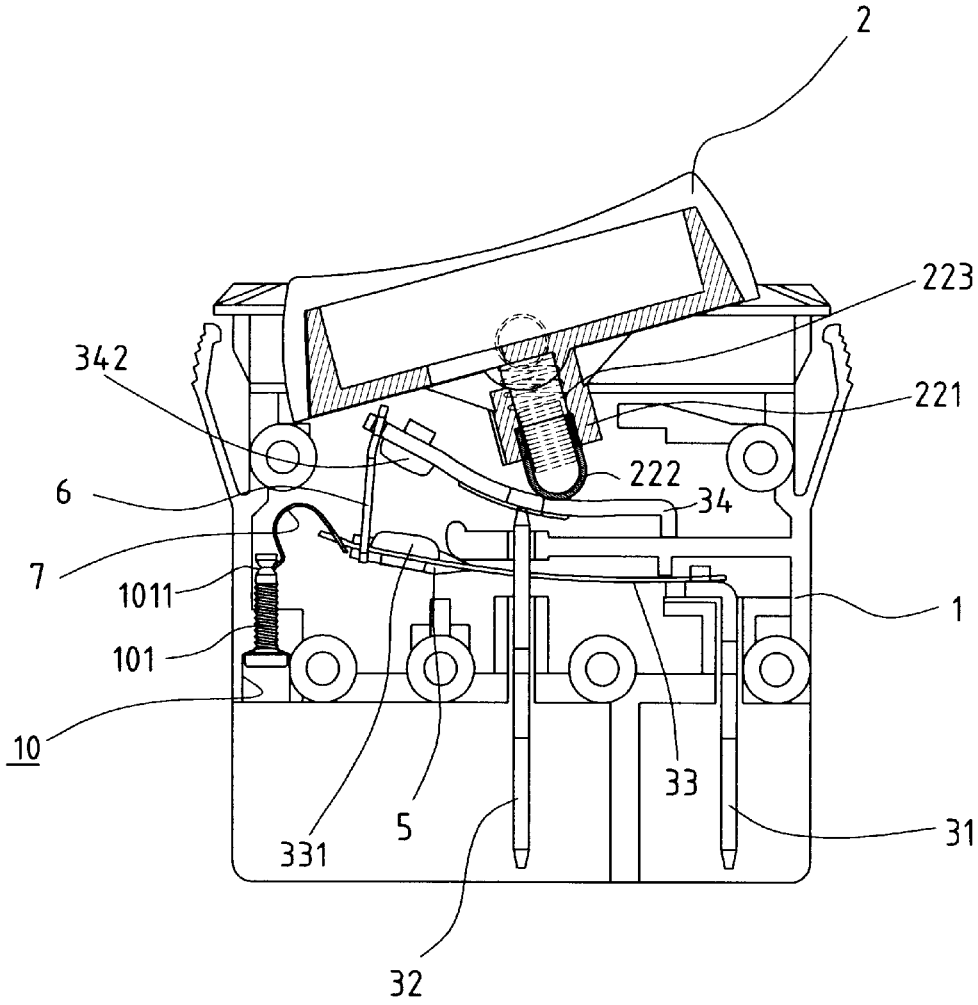
FIG. 2 is a cross-sectional view of the switch in an OFF condition.
Figure 3:
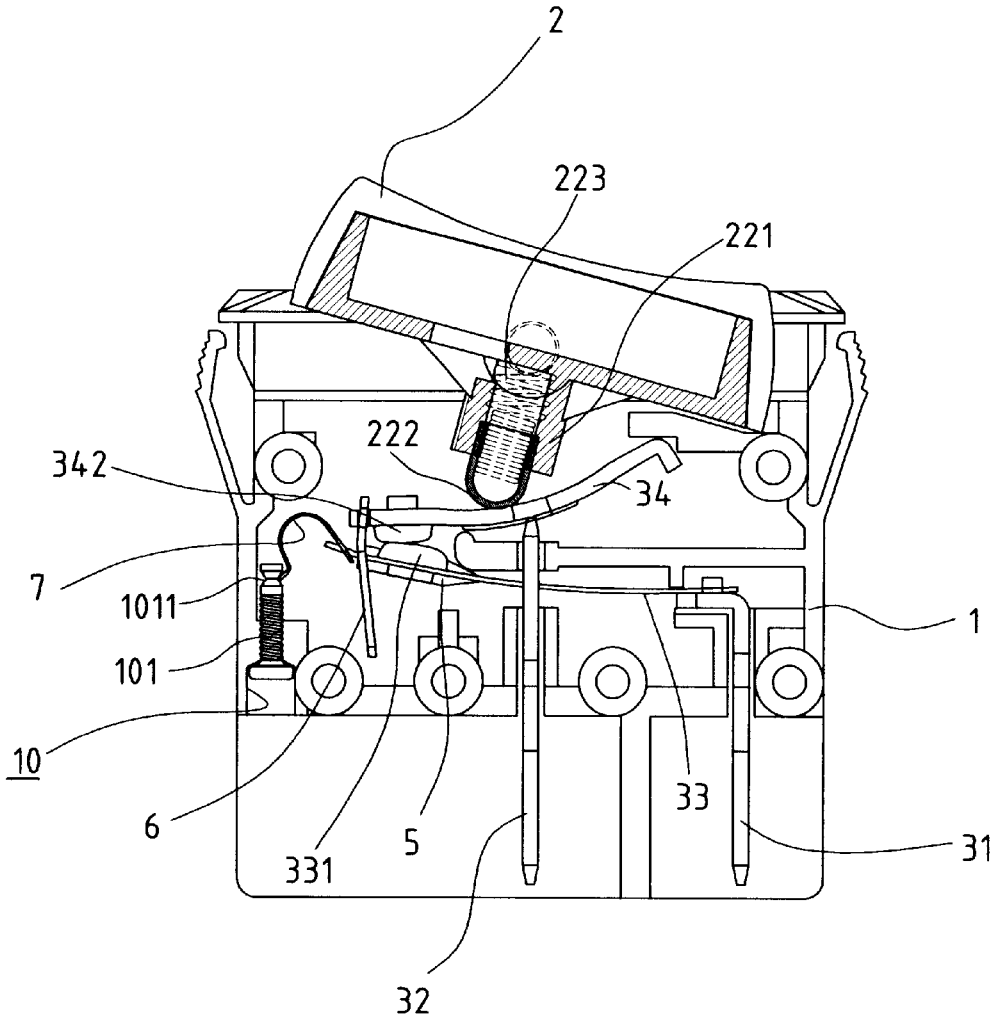
FIG. 3 is a cross-sectional view of the switch in an ON condition.

With reference to the drawings and in particular to FIGS. 1–3, a dual-circuit switch constructed in accordance with the present invention comprises a casing 1 forming an interior space (not labeled) and having opposite side walls (not labeled) defining a top opening 11 in communication with the interior space. Aligned holes 111 are defined in the sidewalls. A rotation button 2 is partially received in the opening 11 and has opposite pivot pins 21 rotatably received in the holes 111 of the casing 1 whereby the button 2 is rotatable between first and second positions respectively associated with ON and OFF conditions of the switch as shown in FIGS. 3 and 2.

Two driver assemblies 22 are formed on an underside of the button 2 and extend into the interior space of the casing 1. Each driver assembly 22 comprises a cylinder 221 extending from the underside of the button 2 inside which a cap 222 is partially and movably received. A biasing element 223, such as a helical spring, is mounted between the cylinder 221 and the cap 222 for biasing the cap 222 away from the cylinder 221. The helical spring 223 is received and retained in both the cylinder 221 and the cap 222.

Two conductive blade pairs 3, 4, each forming a circuit of the switch electrically isolated from each other inside the casing 1, are received in and retained by slots (not labeled) in a bottom of the casing 1 and are spaced by a first partition (not labeled) formed on the underside of the casing 1. Each pair 3, 4 comprises a first conductive blade 31, 41 and a second conductive blade 32, 42 which are spaced from each other by a second transverse partition (not labeled) formed on the underside of the casing 1. All the conductive blades 31, 32, 41, 42 have tails (not labeled) extending beyond the bottom of the casing 1 for external connection.

An opening 321, 421 is defined in each second blade 32, 42. A conductive strip 33, 43 made of a conductive material, such as an alloy or a bimetal, that bends when subject to heat (and thus having a temperature rise) is arranged inside. the casing 1 and has an end attached to each first blade 31, 41 and a second, free end extending through the opening 321, 421 of each second blade 32, 42, forming a cantilever beam. The opening 321, 421 of each second blade 32, 42 is large enough to accommodate the bending and deformation of the associated conductive strip 33, 43 without any physical engagement therebetween.

Each second blade 32, 42 defines a notch 322, 422 in a top edge (not labeled) thereof. A seesaw plate 34, 44 made of a conductive material is arranged inside the casing 1 and has a concave configuration and forms a bottom projection (not labeled) fit in the notch 322, 422 of each second blade 32, 42 whereby the seesaw plate 34, 44 seesaws about the top edge of the second blade 32, 42. The bottom projection of the seesaw plate 34, 44 is formed by pressing the plate 34, 44 and thereby making a recess 341, 441 on a top side thereof and the recessed portion of the plate 34, 44 forms the projection. A movable contact 342, 442 is mounted to a first end of each seesaw plate 34, 44. A stationary contact 331, 431 is mounted to the free end of each conductive strip 33, 43 and corresponds to the movable contact 342, 442.

The driver assemblies 22 of the rotation button 2 are arranged to respectively and operatively correspond to the two seesaw plates 34, 44. The cap 222 of each driver assembly 22 engages the topside of the corresponding seesaw plate 34, 44 and is slidable along the seesaw plate 34, 44 to seesaw the seesaw plate 34, 44. When the button 2 is rotated to the first position (the ON condition, FIG. 3), the caps 222 are simultaneously moved to the first ends of the seesaw plates 34, 44 close to the movable contacts 342, 442 whereby the seesaw plates 3, 4 are simultaneously moved to an engaged position where the movable contacts 342, 442 are respectively brought into engagement with the corresponding stationary contacts 331, 431 of the conductive strips 33, 43. Thus, an electrical connection between the first and second blades 31, 32 (41, 42) of each blade pair 3, 4, through the conductive strip 33, 43, the contacts 331, 342 (431, 442) and the seesaw plate 34, 44, is simultaneously formed.

When the button 2 is rotated to the second position (the OFF condition, FIG. 2), both caps 222 are simultaneously moved to second ends of the seesaw plates 34, 44 away from the movable contacts 342, 442 whereby the seesaw plates 34, 44 are moved to a disengaged position by rotation about the notches 322, 422 of the second blades 32, 42 to separate the movable contacts 342, 442 from the stationary contacts 331, 431. Thus, the electrical connection between the first and second blades 31, 32 (41, 42) is broken simultaneously.

In sliding along the seesaw plates 34, 44 between the first and second ends thereof, the caps 222 are forced toward the button 2 when the caps 222 pass the edges of the second blades 32, 42 by deforming the biasing elements 223. If desired, the caps 222 may be partially received in the recesses 341, 441 defined in the topside of the corresponding seesaw plates 34, 44 to be guided thereby.

Figure 4:
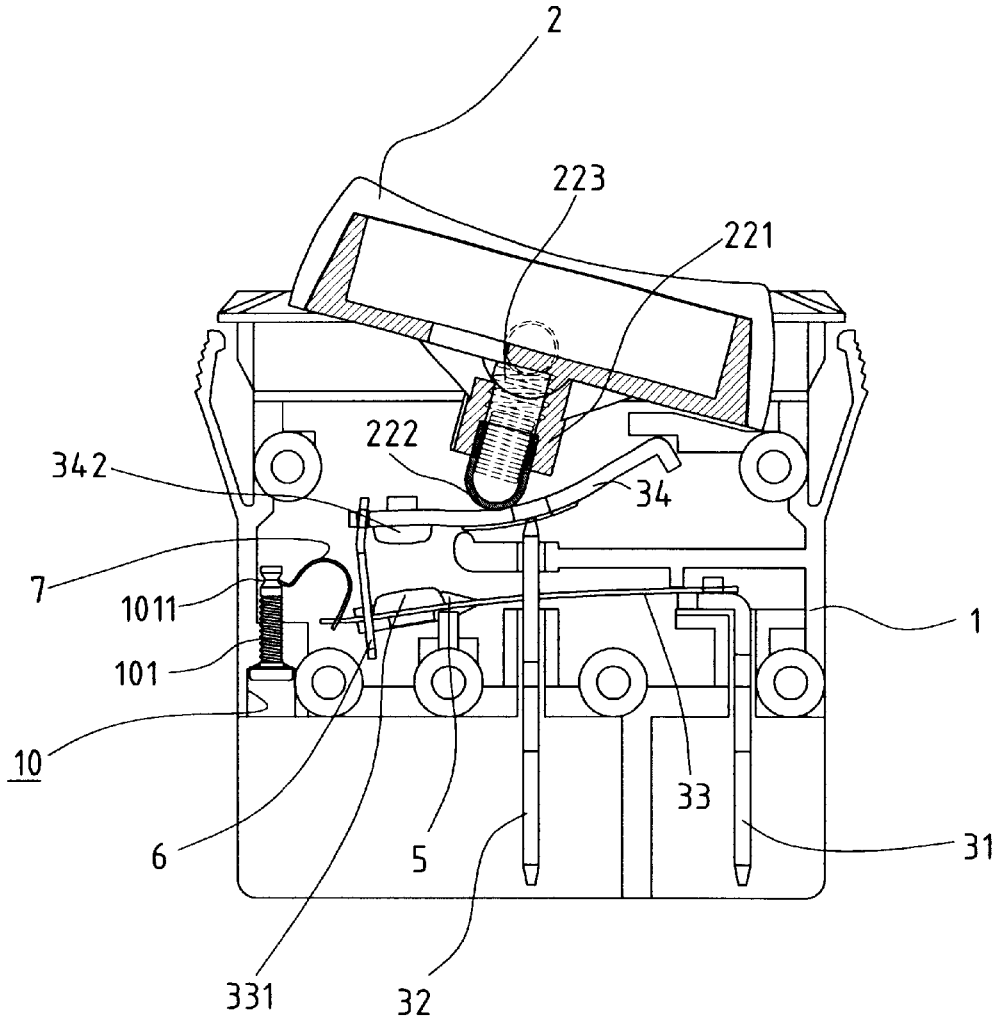
FIG. 4 is a cross-sectional view of the switch in a breaking condition.

Also referring to FIG. 4, when an overload happens, an excessive current flows through the conductive strips 33, 43, causing a significant temperature rise. The conducive strips 33, 43 that are upward concave in the normal operation condition bends in a direction away from the seesaw plates 34, 44 to a downward concave configuration to separate the stationary contacts 331, 431 from the movable contacts 342, 442 thereby breaking the electrical connection between the first and second blades 31, 32 (41, 42) and cutting off the current supplied through the conductive strips 33, 43. This opens the circuit associated with each conductive blade pair 3, 4.

Figure 5A:
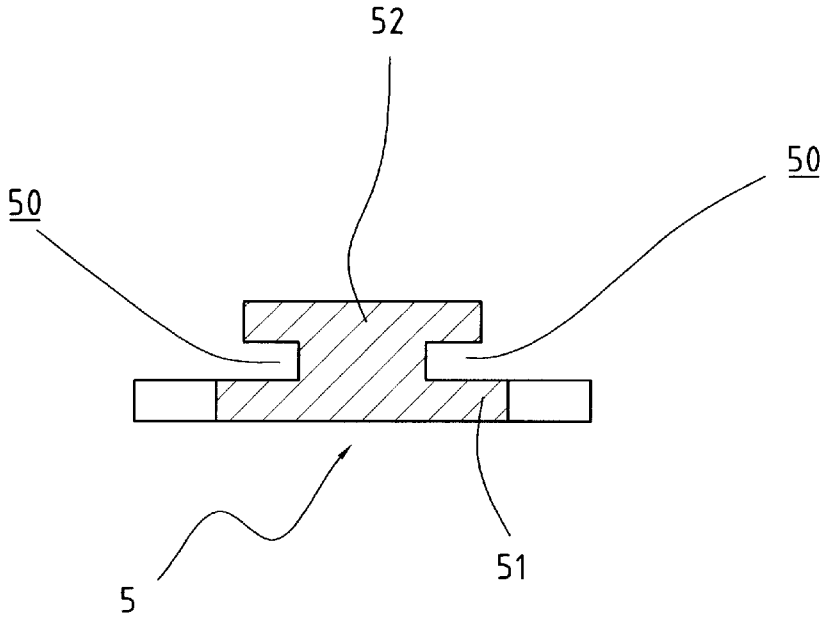
FIG. 5*a* is a cross-sectional view of a coupler of the switch of the present invention.
Figure 5B:
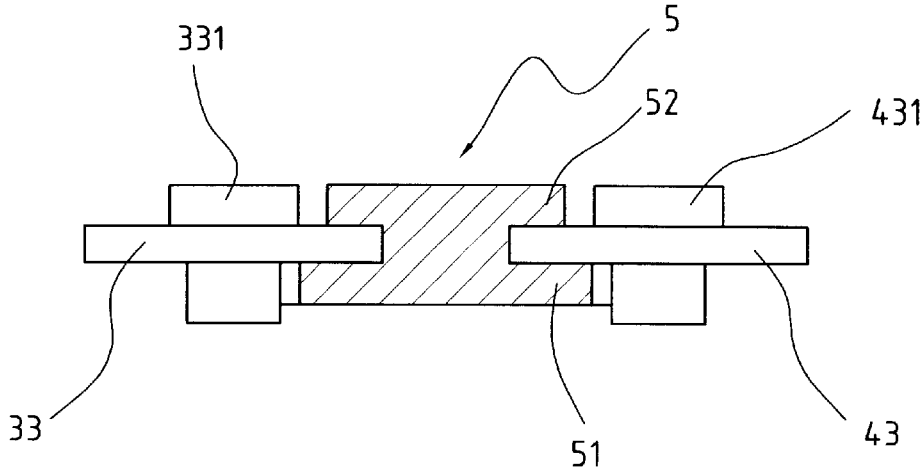
FIG. 5*b* is a cross-sectional view similar to FIG. 5 but showing the coupler coupling conductive strips of two circuits of the switch together.

Also referring to FIGS. 5*a*, 5*b*, to ensure that the conductive strips 33, 43 can bend at the same time to break both circuits simultaneously, a coupler 5 is connected between the conductive strips 33, 43. The coupler 5 comprises a lower plate 51 and an upper plate 52 spaced from and connected to the lower plate 51 by a neck (not labeled) to define slits 50 on opposite sides of the neck for each receiving an edge of a corresponding conductive strip 33, 43. By means of the coupler 5, when one of the conductive strips 33, 43 bends due to overloading, the other conductive strip is caused to bend simultaneously. This ensures that both conductive strips 33, 43 can bend and move to the breaking condition at the same time thereby breaking both circuits simultaneously.

Figure 6:
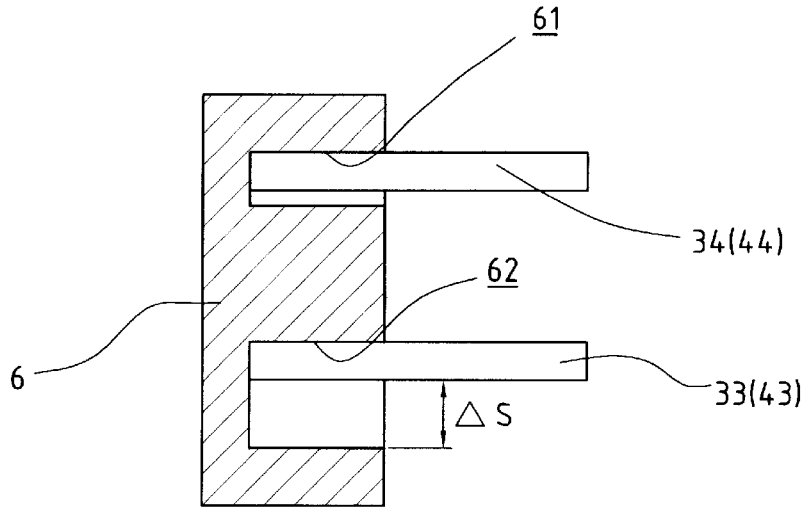
FIG. 6 is a cross-sectional view of a link coupled between a seesaw plate and a conductive strip.
Figure 6A:
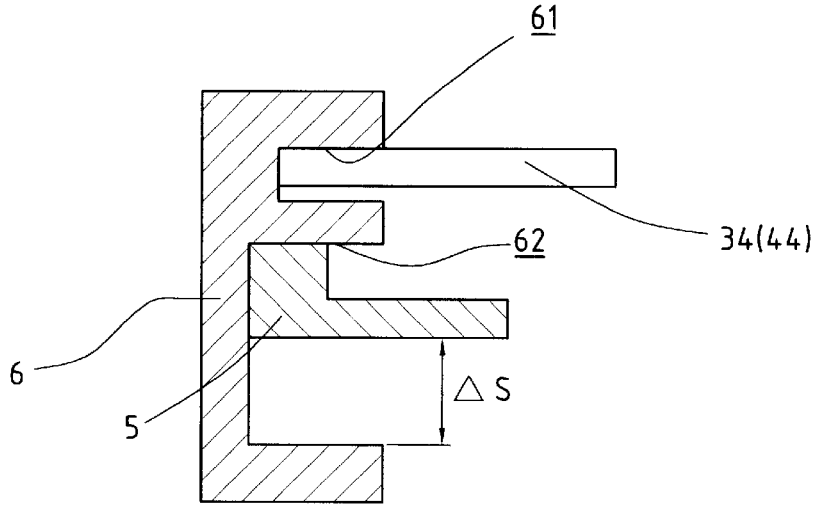
FIG. 6*a* is another cross-sectional view of the link showing the coupler is received in a slot of the link.

Referring back to FIG. 1 and further referring to FIGS. 6 and 6*a*, a link 6 made of insulative materials extends in a longitudinal direction between the first end of one of the seesaw plates (for example seesaw plate 34 in this case) and the free end of the corresponding conductive strip 33 and is interconnected to the seesaw plate 34 and the conductive strip 33 (as well as the coupler 5 to which the edge of the conductive strip 33 is attached). To allow the coupler 5 to properly connect to the link 6, a cutoff 53 is defined in the coupler 5 to partially accommodate the link 6. The link 6 has a first slot 61 and a second slot 62. One of the slots 61, 62 is extended in the longitudinal direction. In the embodiment shown in FIGS. 1, 6 and 6*a*, the second slot 62 is extended and has a predetermined longitudinal dimension defined by upper and lower ends (both not labeled). The first end of the seesaw plate 34 is received in the first slot 61 and is thus attached to the link 6 with a limited rotation with respect to the link 6. The free end of the conductive strip 33 is received in the second slot 62 and is movable between the upper and lower ends of the second slot 62. When the button 2 is rotated to the first position (the On condition, FIG. 3), the link 6 is moved by the seesaw plate 34 relative to the free end of the conductive strip 33, causing the free end of the conductive strip 33 to engage and be stopped by the upper end of the second slot 62 of the link 6. On the other hand, when the button 2 is rotated to the second position (the OFF condition, FIG. 2), the link 6 is moved by the seesaw plate 34 in an opposite direction, causing the free end of the conductive strip 33 to engage and be stopped by the lower ends of the second slots 62 of the link 6. In this respect, the second slot 62 has a longitudinal dimension or a moving distance (ΔS) substantially corresponding to the movement stroke of the movable contact 342 that is mounted to the first end of the seesaw plate 34 toward the stationary contact 331 that is mounted to the free end of the conductive strip 33 whereby no constraint is imposed to the movement of the seesaw plate 34 with respect to the conductive strip 33 by the link 6 during a normal operation.

The dimension of the second slot 62 of the link 6 and the dimension of the opening 321 of the second blade 32 are sized so that when an overload occurs during an ON condition with electrical current supplied through the conductive strips 33, 34, the conductive strip 33 bends away from the seesaw plate 34 or is caused to bend away from the seesaw plate 34 by the bending of the conductive strip 43, the longitudinal dimension of the second slot 62 allows the free end of the conductive strip 33 to move away from the first end of the seesaw plate 34. The movement of the free end of the conductive strip 33 is stopped by the lower end of the second slot 62 of the link 6 and is not allowed to contact the opening 321 of the second blade 32.

To return to the normal operation from the breaking condition, the button 2 is moved to the OFF condition. The seesaw plate 34 is moved to the OFF position and the free end of the conductive strip 33 is forced to move in unison with the seesaw plate 34 by means of the link 6. The seesaw plate 44 is moved to the OFF condition simultaneously with the seesaw plate 34 by the button 2 and the conductive strip 43 is moved in unison with the conductive strip 33 by the coupler 5. Thus, the switch is back to the OFF condition and is ready for next actuation. The button 2 may then be moved to the ON condition to engage the movable contacts 342, 442 with the stationary contacts 331, 431 for resuming electrical connection between the first and second blades 31, 32 (41, 42) of each pair 3, 4.

The link 6 and the coupler 5 ensure that the free end of the conductive strip 33 and thus the free end of the conductive strip 43 can be brought back to their unbent positions for next actuation of the switch. Even when the mechanical property of the conductive strips 33, 43 deteriorate due to aging or other reasons, the link 6 and the coupler 5 still provide means for simultaneously returning the conductive strips 33, 43 back to their unbent positions.

Figure 7:
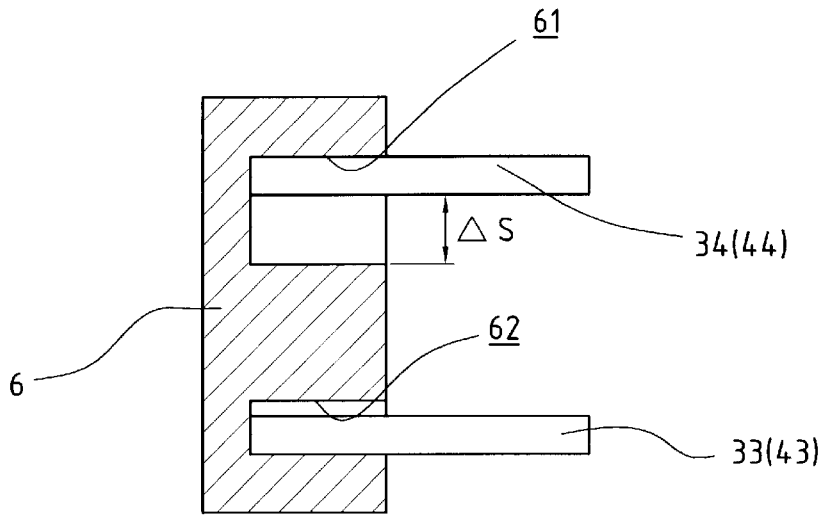
FIG. 7 is a cross-sectional view similar to FIG. 6 but showing a variation thereof.
Figure 7A:
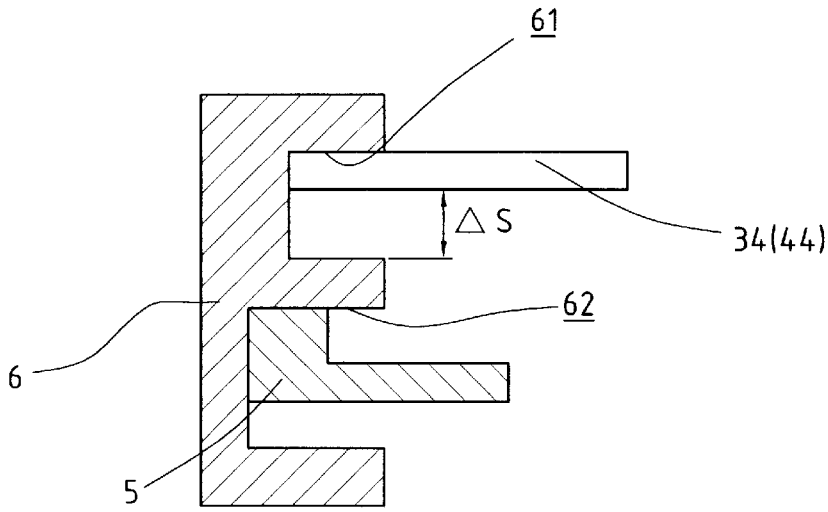
FIG. 7*a* is a cross-sectional view similar to FIG. 6*a* but showing a variation thereof.

FIGS. 7 and 7*a* show a variation of the example illustrated in FIGS. 6 and 6*a*. In the variation of FIGS. 7 and 7*a*, the first slot 61, rather than the second slot 62, of the link 6 is extended in the longitudinal direction. Similarly, due to the longitudinal dimension of the first slot 61, the movement of the conductive strip 33 is not subject to any constraint caused by the link 6 while the link 6 is able to bring the conductive strip 33 from a bent condition (caused by overload of the switch) back to the normal operation condition.

A U-shaped leaf spring 7 has opposite legs of which a first one is pivotally connected to the casing 1 and a second one pivotally coupled to the free end of the conductive strip 33. The second leg of the leaf spring 7 defines an opening 71 and the free end of the conductive strip 33 forms an extension having barbed end 332. (In the embodiment illustrated, there is no need for the other conductive strip 43 to form the barbed extension. However, to simplify the manufacturing, the conductive strip 43 may have exactly the same structure as the conductive strip 33 and thus having a barbed extension 432.) The extension 332 is received in the opening 71, forming the pivotal coupling between the conductive strip 33 and the leaf spring 7. The pivotal connection of the first leg of the leaf spring 7 to the casing 1 allows the second leg of the leaf spring 7 to move with the free end of the conductive strip 33 when the conductive strip 33 is moved to the breaking condition due to overloading.

The leaf spring 7 is preloaded and applies a force to the free end of the conductive strip 33 in a direction pointing from the pivotal connection of the first leg to the pivotal coupling of the second leg. When the conductive strip 33 is in a normal operation condition, the pivotal coupling of the second leg is located above the pivotal connection of the first leg. The spring force of the leaf spring 7 acts in such a direction to retain the conductive strip 33 in an upward concave condition which leads to the normal operation of the switch (see FIGS. 2 and 3). The conductive strip 43 is also maintained in the upward concave condition by means of the coupler 5. When an overload occurs, either one of the conductive strips 33, 43 bends to a downward concave condition and the other one of the conductive strips 33, 43 is forced to bend at the same time due to the coupler 5. The second leg of the leaf spring 7 is thus moved by the conductive strip 33 and the movement of the second leg of the leaf spring 7 moves the pivotal coupling of the second leg to be below the pivotal connection of the first leg whereby the spring force of the leaf spring 7 acts on the free end of the conductive strip 33 in such a direction to retain the conductive strip 33 and thus the conductive strip 43 in the breaking condition (see FIG. 4).

The spring force of the leaf spring 7 is overcome by a driving force provided by the movement of the link 6 to the conductive strip 33 when the button 2 is manually switched to the OFF condition. Thus, the conductive strip 33 can be moved back to the normal operation condition against the leaf spring 7. The leaf spring 7 ensures operation reliability of the conductive strips 33, 43 in both the normal operation condition and the breaking condition.

A bolt 101 is threadingly received in an inner-threaded hole 10 defined in the housing 1. A circumferential groove 1011, preferably having a V-shaped cross section, is defined in a free end of the bolt 101. The U-shaped leaf spring 7 has a flange (not labeled) extending from the first leg of the spring 7 and receivingly engaging the groove 1011 of the bolt 101 for pivotally connecting the first leg of the leaf spring 7 to the casing 1. The pivotal connection of the first leg of the leaf spring 7 inside the casing 1 is position-adjustable by turning the bolt 101 to change relative position of the bolt 101 with respect to the casing 1.

Figure 8:
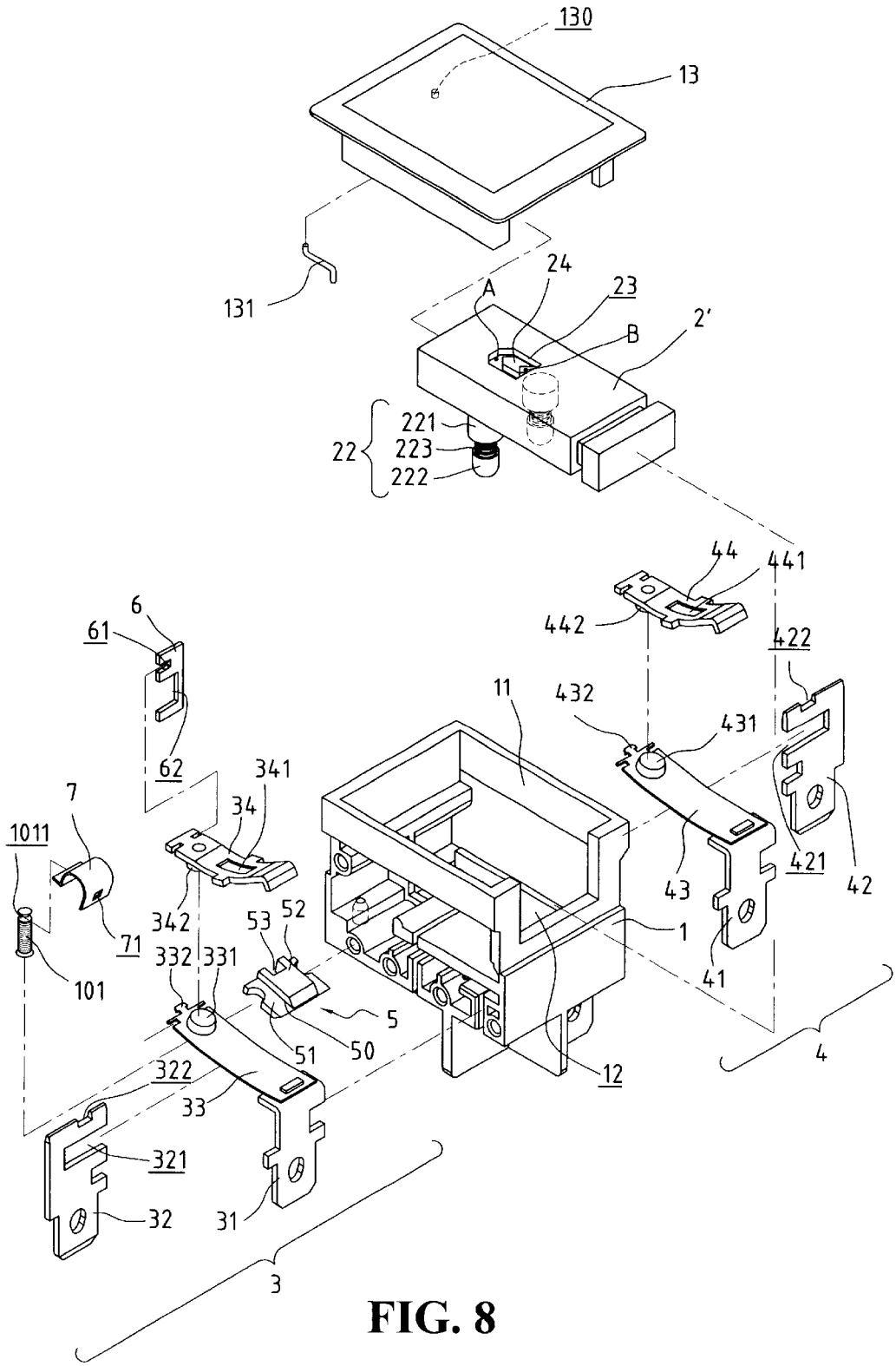
FIG. 8 is an exploded view of a dual-circuit switch constructed in accordance with a second embodiment of the present invention.
Figure 9:
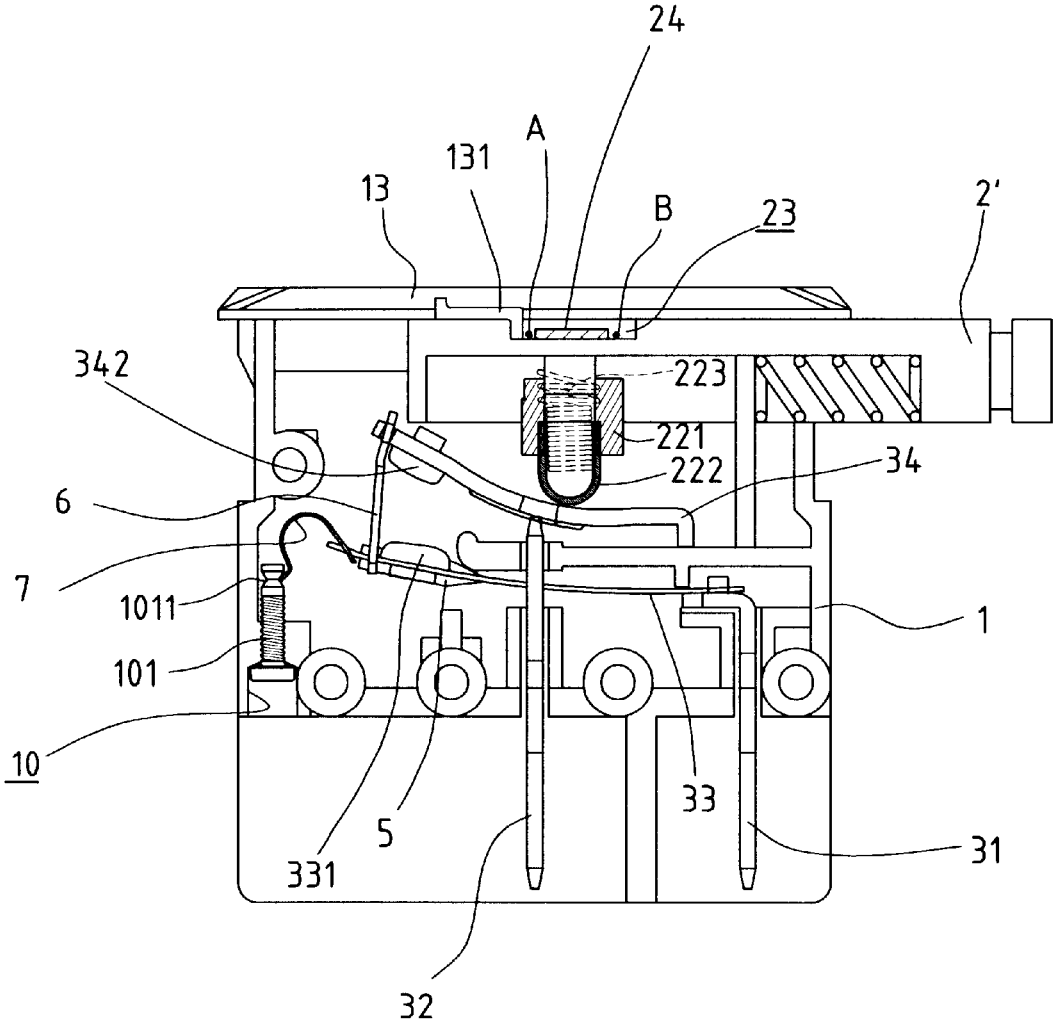
FIG. 9 is a cross-sectional view of the switch in an OFF condition.
Figure 10:
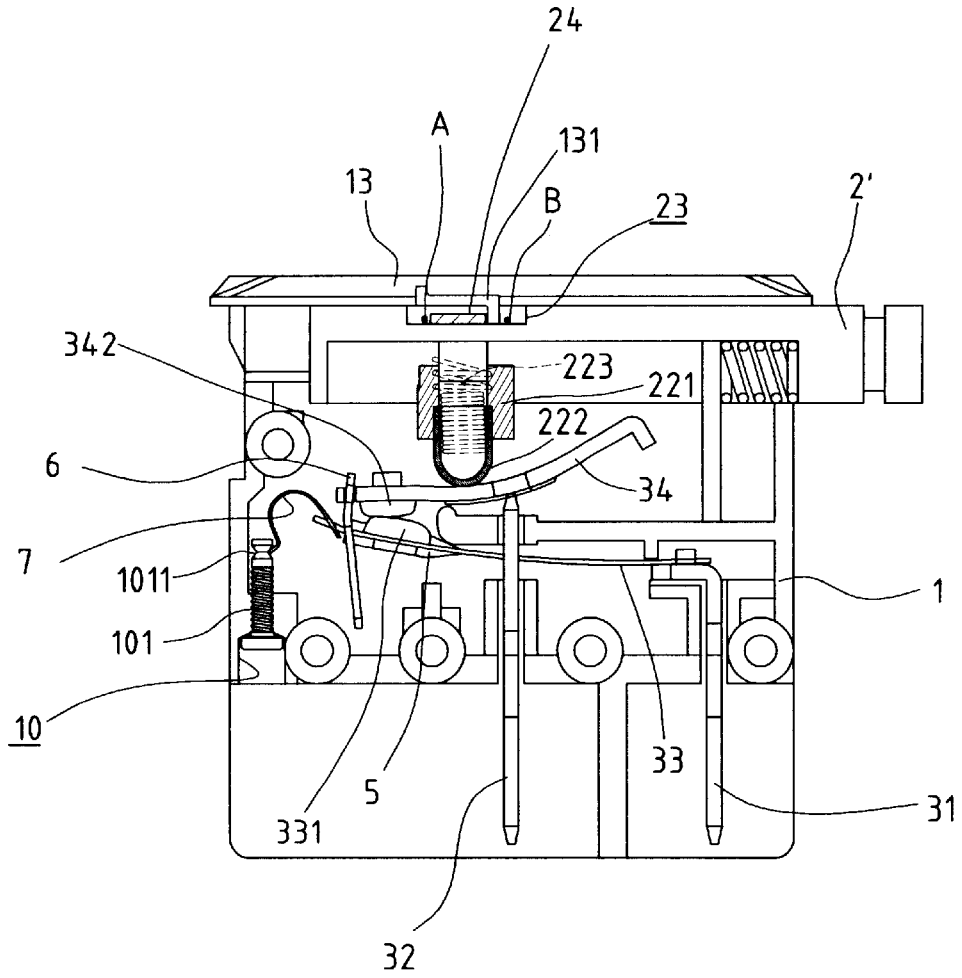
FIG. 10 is a cross-sectional view of the switch in an ON condition.

FIGS. 8–10 show a switch constructed in accordance with a second embodiment of the present invention, comprising a casing 1 forming an interior space (not labeled) and having opposite side walls (not labeled) defining a top opening 11 and a side opening 12 both in communication with the interior space. A cover 13 is fit into the top opening 11 and is fixed to the casing 1. A hole 130 is defined in an inside surface (not labeled) of the cover 13. A Z-shaped bar 131 has a major central section and two minor end sections extending from opposite ends of the central section in opposite directions. One of end sections of the bar 131 is fit into the hole 130 whereby the bar 131 is attached to the inner surface of the cover 13.

A pushbutton 2' is movably received in the interior space of the casing 1 through the side opening 12. A guide block 24 having a polygonal configuration is formed on topside of the pushbutton 2' defining a multi-section channel 23 surrounding the block 24. The channel 23 forms a closed loop path or route having stop points A and B. The second end section of the bar 131 is movably received in the channel 23 and is guided to move along the route. The pushbutton 2' is linearly movable with respect to the casing 1 between an outer position (FIG. 9) and an inner position (FIG. 10). By repeatedly pushing the pushbutton 2', the end section of the bar 131 is moved along the channel 23 between the stop points A and B. When the pushbutton 2' is pushed once and moved to the inner position, the end section of the bar 131 is moved to the stop point B and trapped there for retaining the pushbutton 2' at the inner position. When the pushbutton 2' is pushed again and is thus moved to the outer position, the end section of the bar 131 is moved to the stop point A. The outer and inner positions of the pushbutton 2' respectively associated with OFF and ON conditions of the switch as shown in FIGS. 9 and 10. The pushbutton 2' is spring-biased for helping movement between the stop points A and B.

Two driver assemblies 22 are formed on an underside of the pushbutton 2' and extend into the interior space of the casing 1. Each driver assembly 22 comprises a cylinder 221 extending from the underside of the pushbutton 2' inside which a cap 222 is partially and movably received. A biasing element 223, such as a helical spring, is mounted between the cylinder 221 and the cap 222 for biasing the cap 222 away from the cylinder 221. The helical spring 223 is received and retained in both the cylinder 221 and the cap 222.

Two conductive blade pairs 3, 4, each forming a circuit of the switch electrically isolated from each other inside the casing 1, are received in and retained by slots (not labeled) in a bottom of the casing 1 and are spaced by a first partition (not labeled) formed on the underside of the casing 1. Each pair 3, 4 comprises a first conductive blade 31, 41 and a second conductive blade 32, 42 which are spaced from each other by a second transverse partition (not labeled) formed on the underside of the casing 1. All the conductive blades 31, 32, 41, 42 have tails (not labeled) extending beyond the bottom of the casing 1 for external connection.

An opening 321, 421 is defined in each second blade 32, 42. A conductive strip 33, 43 made of a conductive material, such as an alloy or a bimetal, that bends when subject to heat (and thus having a temperature rise) is arranged inside the casing 1 and has an end attached to each first blade 31, 41 and a second, free end extending through the opening 321, 421 of each second blade 32, 42, forming a cantilever beam. The opening 321, 421 of each second blade 32, 42 is large enough to accommodate the bending and deformation of the associated conductive strip 33, 43 without any physical engagement therebetween.

Each second blade 32, 42 defines a notch 322, 422 in a top edge (not labeled) thereof. A seesaw plate 34, 44 made of a conductive material is arranged inside the casing 1 and has a concave configuration and forms a bottom projection (not labeled) fit in the notch 322, 422 of each second blade 32, 42 whereby the seesaw plate 34, 44 seesaws about the top edge of the second blade 32, 42. The bottom projection of the seesaw plate 34, 44 is formed by pressing the plate 34, 44 and thereby making a recess 341, 441 on a top side thereof and the recessed portion of the plate 34, 44 forms the projection. A movable contact 342, 442 is mounted to a first end of each seesaw plate 34, 44. A stationary contact 331, 431 is mounted to the free end of each conductive strip 33, 43 and corresponds to the movable contact 342, 442.

The driver assemblies 22 of the pushbutton 2' are arranged to respectively and operatively correspond to the two seesaw plates 34, 44. The cap 222 of each driver assembly 22 engages the topside of the corresponding seesaw plate 34, 44 and is slidable along the seesaw plate 34, 44 to seesaw the seesaw plate 34, 44. When the pushbutton 2' is moved to the inner position (the ON condition, FIG. 10), the caps 222 are simultaneously moved to the first ends of the seesaw plates 34, 44 close to the movable contacts 342, 442 whereby the seesaw plates 3, 4 are simultaneously moved to an engaged position where the movable contacts 342, 442 are respectively brought into engagement with the corresponding stationary contacts 331, 431 of the conductive strips 33, 43. Thus, an electrical connection between the first and second blades 31, 32 (41, 42) of each blade pair 3, 4, through the conductive strip 33, 43, the contacts 331, 342 (431, 442) and the seesaw plate 34, 44, is simultaneously formed.

When the pushbutton 2' is moved to the outer position (the OFF condition, FIG. 9), both caps 222 are simultaneously moved to second ends of the seesaw plates 34, 44 away from the movable contacts 342, 442 whereby the seesaw plates 34, 44 are moved to a disengaged position by rotation about the notches 322, 422 of the second blades 32, 42 to separate the movable contacts 342, 442 from the stationary contacts 331, 431. Thus, the electrical connection between the first and second blades 31, 32 (41, 42) is broken simultaneously.

In sliding along the seesaw plates 34, 44 between the first and second ends thereof, the caps 222 are forced toward the button 2 when the caps 222 pass the edges of the second blades 32, 42 by deforming the biasing elements 223. If desired, the caps 222 may be partially received in the recesses 341, 441 defined in the topside of the corresponding seesaw plates 34, 44 to be guided thereby.

Figure 11:
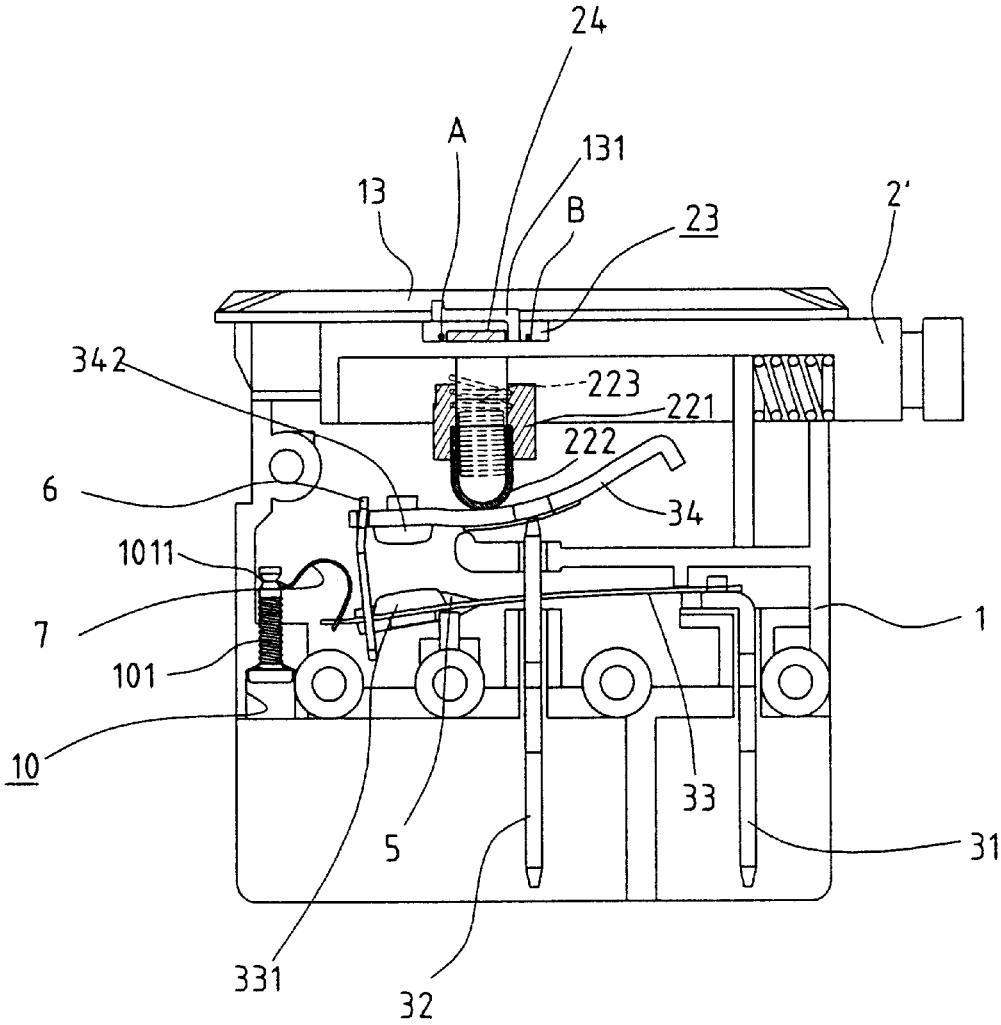
FIG. 11 is a cross-sectional view of the switch in a breaking condition.

Also referring to FIG. 11, when an overload happens, an excessive current flows through the conductive strips 33, 43, causing a significant temperature rise. The conducive strips 33, 43 that are upward concave in the normal operation condition bends in a direction away from the seesaw plates 34, 44 to a downward concave configuration to separate the stationary contacts 331, 431 from the movable contacts 342, 442 thereby breaking the electrical connection between the first and second blades 31, 32 (41, 42) and cutting off the current supplied through the conductive strips 33, 43. This opens the circuit associated with each conductive blade pair 3, 4.

To ensure that the conductive strips 33, 43 can bend at the same time to break both circuits simultaneously, a coupler 5 is connected between the conductive strips 33, 43. The coupler 5 comprises a lower plate 51 and an upper plate 52 spaced from and connected to the lower plate 51 by a neck (not labeled) to define slits 50 on opposite sides of the neck for each receiving an edge of a corresponding conductive strip 33, 43. By means of the coupler 5, when one of the conductive strips 33, 43 bends due to overloading, the other conductive strip is caused to bend simultaneously. This ensures that both conductive strips 33, 43 can bend and move to the breaking condition at the same time thereby breaking both circuits simultaneously.

Referring back to FIG. 8, a link 6 made of insulative materials extends in a longitudinal direction between the first end of one of the seesaw plates (for example seesaw plate 34 in this case) and the free end of the corresponding conductive strip 33 and is interconnected to the seesaw plate 34 and the conductive strip 33 (as well as the coupler 5 to which the edge of the conductive strip 33 is attached). To allow the coupler 5 to properly connect to the link 6, a cutoff 53 is defined in the coupler 5 to partially accommodate the link 6. The link 6 has a first slot 61 and a second slot 62. One of the slots 61, 62 is extended in the longitudinal direction. In the embodiment shown in FIG. 8, the second slot 62 is extended and has a predetermined longitudinal dimension defined by upper and lower ends (both not labeled). The first end of the seesaw plate 34 is received in the first slot 61 and is thus attached to the link 6 with a limited rotation with respect to the link 6. The free end of the conductive strip 33 is received in the second slot 62 and is movable between the upper and lower ends of the second slot 62. When the pushbutton 2' is moved to the inner position (the On condition, FIG. 10), the link 6 is moved by the seesaw plate 34 relative to the free end of the conductive strip 33, causing the free end of the conductive strip 33 to engage arid be stopped by the upper end of the second slot 62 of the link 6. On the other hand, when the pushbutton 2' is moved to the outer position (the OFF condition, FIG. 9), the link 6 is moved by the seesaw plate 34 in an opposite direction, causing the free end of the conductive strip 33 to engage and be stopped by the lower ends of the second slots 62 of the link 6. In this respect, the second slot 62 has a longitudinal dimension or a moving distance substantially corresponding to the movement stroke of the movable contact 342 that is mounted to the first end of the seesaw plate 34 toward the stationary contact 331 that is mounted to the free end of the conductive strip 33 whereby no constraint is imposed to the movement of the seesaw plate 34 with respect to the conductive strip 33 by the link 6 during a normal operation.

The dimension of the second slot 62 of the link 6 and the dimension of the opening 321 of the second blade 32 are sized so that when an overload occurs during an ON condition with electrical current supplied through the conductive strips 33, 34, the conductive strip 33 bends away from the seesaw plate 34 or is caused to bend away from the seesaw plate 34 by the bending of the conductive strip 43, the longitudinal dimension of the second slot 62 allows the free end of the conductive strip 33 to move away from the first end of the seesaw plate 34. The movement of the free end of the conductive strip 33 is stopped by the lower end of the second slot 62 of the link 6 and is not allowed to contact the opening 321 of the second blade 32.

To return to the normal operation from the breaking condition, the pushbutton 2' is moved to the outer position (the OFF condition). The seesaw plate 34 is moved to the OFF position and the free end of the conductive strip 33 is forced to move in unison with the seesaw plate 34 by means of the link 6. The seesaw plate 44 is moved to the OFF condition simultaneously with the seesaw plate 34 by the pushbutton 2' and the conductive strip 43 is moved in unison with the conductive strip 33 by the coupler 5. Thus, the switch is back to the OFF condition and is ready for next actuation. The pushbutton 2' may then be moved to the inner position (the ON condition) to engage the movable contacts 342, 442 with the stationary contacts 331, 431 for resuming electrical connection between the first and second blades 31, 32 (41, 42) of each pair 3, 4.

The link 6 and the coupler 5 ensure that the free end of the conductive strip 33 and thus the free end of the conductive strip 43 can be brought back to their unbent positions for next actuation of the switch. Even when the mechanical property of the conductive strips 33, 43 deteriorate due to aging or other reasons, the link 6 and the coupler 5 still provide means for simultaneously returning the conductive strips 33, 43 back to their unbent positions.

A U-shaped leaf spring 7 has opposite legs of which a first one is pivotally connected to the casing 1 and a second one pivotally coupled to the free end of the conductive strip 33. The second leg of the leaf spring 7 defines an opening 71 and the free end of the conductive strip 33 forms an extension having barbed end 332. (In the embodiment illustrated, there is no need for the other conductive strip 43 to form the barbed extension. However, to simplify the manufacturing, the conductive strip 43 may have exactly the same structure as the conductive strip 33 and thus having a barbed extension 432.) The extension 332 is received in the opening 71, forming the pivotal coupling between the conductive strip 33 and the leaf spring 7. The pivotal connection of the first leg of the leaf spring 7 to the casing 1 allows the second leg of the leaf spring 7 to move with the free end of the conductive strip 33 when the conductive strip 33 is moved to the breaking condition due to overloading.

The leaf spring 7 is preloaded and applies a force to the free end of the conductive strip 33 in a direction pointing from the pivotal connection of the first leg to the pivotal coupling of the second leg. When the conductive strip 33 is in a normal operation condition, the pivotal coupling of the second leg is located above the pivotal connection of the first leg. The spring force of the leaf spring 7 acts in such a direction to retain the conductive strip 33 in an upward concave condition which leads to the normal operation of the switch (see FIGS. 9 and 10). The conductive strip 43 is also maintained in the upward concave condition by means of the coupler 5. When an overload occurs, either one of the conductive strips 33, 43 bends to a downward concave condition and the other one of the conductive strips 33, 43 is forced to bend at the same time due to the coupler 5. The second leg of the leaf spring 7 is thus moved by the conductive strip 33 and the movement of the second leg of the leaf spring 7 moves the pivotal coupling of the second leg to be below the pivotal connection of the first leg whereby the spring force of the leaf spring 7 acts on the free end of the conductive strip 33 in such a direction to retain the conductive strip 33 and thus the conductive strip 43 in the breaking condition (see FIG. 11).

The spring force of the leaf spring 7 is overcome by a driving force provided by the movement of the link 6 to the conductive strip 33 when the pushbutton 2' is manually switched to the OFF condition. Thus, the conductive strip 33 can be moved back to the normal operation condition against the leaf spring 7. The leaf spring 7 ensures operation reliability of the conductive strips 33, 43 in both the normal operation condition and the breaking condition.

A bolt 101 is threadingly received in an inner-threaded hole 10 defined in the housing 1. A circumferential groove 1011, preferably having a V-shaped cross section, is defined in a free end of the bolt 101. The U-shaped leaf spring 7 has a flange (not labeled) extending from the first leg of the spring 7 and receivingly engaging the groove 1011 of the bolt 101 for pivotally connecting the first leg of the leaf spring 7 to the casing 1. The pivotal connection of the first leg of the leaf spring 7 inside the casing 1 is position-adjustable by turning the bolt 101 to change relative position of the bolt 101 with respect to the casing 1.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A switch comprising:

a casing defining an interior space;

two pairs of conductive blades, each comprising first and second conductive blades arranged and fixed in the interior space, the first and second blades having tails extending beyond the casing for external connection;

a conductive strip made of a material that bends from a normal operation condition to a breaking condition when subject to a temperature rise, the strip having an end fixed to the first blade of each conductive blade pair and an opposite, free end;

a conductive seesaw plate rotatably supported in the casing and in electrical connection with the second blade of each conductive blade pair, the seesaw plate being rotatable between engaged position where a first end of the seesaw plate engages the free end of the conductive strip thereby forming an electrical connection between the first and second blades of the associated conductive blade pair and a disengaged position where the first end of the seesaw plate disengages from the conductive strip thereby electrically disconnecting the second blade from the first blade;

a coupler made of insulation material coupled between the conductive strips of the conductive blade pairs;

wherein with the conductive strips at the normal operation condition and the seesaw plates at the engaged position, when an excessive current flows through one of the conductive strips, the temperature of the conductive strip rises, causing said one conductive strip to bend and move to the breaking condition and breaking the electrical connection between the first and second blades of the conductive blade pair associated with said one conductive strip and wherein the movement of the first conductive strip causes the coupler to force a second one of the conductive strips to bend and move in unison with the first conductive strip thereby breaking the electrical connection between the first and second blades associated therewith at the same time.

2. The switch as claimed in claim 1, wherein the coupler is arranged between the conductive strips and forms slots on opposite sides for respectively receiving and retaining edges of the conductive strips.

3. The switch as claimed in claim 2, wherein the coupler comprises a lower plate and an upper plate opposite to and spaced from the lower plate to define the slots on opposite sides thereof.

4. The switch as claimed in claim 1, further comprising a link coupled between a first one the conductive strips and a first one of the seesaw plates, the link being configured to impose no constraint to both the first conductive strip and the first seesaw plate when the first conductive strip is in the normal operation condition and also allowing the first conductive strip to bend freely to the breaking condition and wherein with the first conductive strip in the breaking condition, when the first seesaw plate is moved to the disengaged position, the link drives the first conductive strip to move in unison with the first seesaw plate to the normal operation condition, the movement of the first conductive strip causing the coupler to move a second one of the conductive strips in unison with the first conductive strip.

5. The switch as claimed in claim 4, wherein the link is coupled to the first end of the first seesaw plate and forms an elongated slot having a predetermined longitudinal dimension defined by upper and lower ends of the elongated slot, the free end of the first conductive strip being received in the elongated slot and being allowed to move with respect to the elongated slot, the longitudinal dimension being such that when the first end of the first seesaw plate moves between the engaged and disengaged positions, the free end of the first conductive strip does not engage the upper and lower ends of the elongated slot and is thus not caused to move by the link and such that with the first conductive strip in the breaking condition, when the first seesaw plate moves from the engaged position to the disengaged position, the free end of the first conductive strip engages and is driven by the lower end of the elongated slot to move back to the normal operation condition.

6. The switch as claimed in claim 4, wherein the link is coupled to the free end of the first conductive plate and forms an elongated slot having a predetermined longitudinal dimension defined by upper and lower ends of the elongated slot, the first end of the first seesaw plate being received in the elongated slot and being allowed to move with respect to the elongated slot, the longitudinal dimension being such that when the first end of the first seesaw plate moves between the engaged and disengaged positions, the first end of the first seesaw plate does not engage the upper and lower ends of the elongated slot and the first conductive strip is not caused to move by the link and such that with the first conductive strip in the breaking condition, when the first seesaw plate moves from the engaged position to the disengaged position, the first end of the first seesaw plate engages the upper end of the slot and drives the link to move the free end of the first conductive strip back to the normal operation condition.

7. The switch as claimed in claim 1, further comprising a biasing element having a first end pivotally connected to the casing and a second end coupled to the free end of at least one of the conductive strips, the biasing element applying a retention force to retain the at least one conductive strip in the breaking condition.

8. The switch as claimed in claim 7, wherein the biasing element comprises a U-shaped leaf spring having a first leg pivotally connected to the casing and a second end coupled to the free end of the conductive strip.

9. The switch as claimed in claim 8, wherein the leaf spring is configured to have the coupling between the second leg and the conductive strip movable between opposite sides of the pivotal connection of the first leg to the casing when the conductive strip is moved between the normal operation condition and the breaking condition.

10. The switch as claimed in claim 9, further comprising a bolt threadingly received in an inner-threaded hole of the casing, a groove being defined in the bolt to pivotally receiving an extension of the first leg of the spring thereby pivotally connecting the first leg to the casing.

11. The switch as claimed in claim 10, wherein the groove of the bolt is position-adjustable with respect to the casing by turning the bolt with respect to the casing.

12. The switch as claimed in claim 1, wherein the second blade of each conductive blade pair has a top edge defining a notch and wherein each seesaw plate has a bottom side forming a projection rotatably received in the notch of the second blade thereby forming the electrical connection between the seesaw plate and the second blade and rotatably supporting the seesaw plate in the casing.

13. The switch as claimed in claim 1, wherein the casing forms a top opening defined by opposite side walls and in communication with the interior space and wherein the switch further comprises a control button in driving engagement with the seesaw plate, the control button forming pivot pins rotatably received in holes defined in side walls of the top opening of the casing for rotatably mounting the control button to the casing whereby the control button is rotatable between first and second positions for driving the seesaw plate between engaged and disengaged positions.

14. The switch as claimed in claim 1, wherein the casing defines a top opening and a side opening in communication with the top opening and the interior space of the casing, and wherein the switch further comprises a control button received in the casing through the side opening and in driving engagement with the seesaw plate, the control button being movable with respect to the casing between first and second positions to drive the seesaw plate between the engaged and disengaged positions, a cover fit to the top opening, a control bar mounted to the cover and extending into a channel defined in a top side of the control button, the movement of the control button with respect to the casing being guided by the bar that moves along the channel between two stop points respectively corresponding to the first and second positions.

15. The switch as claimed in claim 14, wherein the channel forms a closed loop path for the bar whereby when the control button is actuated once, the bar moving with respect to the control button from a first stop point to a second stop point and when the control button is actuated second time, the bar moving from the second stop point back to the first stop point.

16. The switch as claimed in claim 15, wherein the control button is spring biased for returning from the second stop point back to the first stop point.

17. The switch as claimed in claim 1, further comprising a control button movable between ON and OFF positions and a driver assembly mounted to the control button and in physical engagement with the seesaw plate of each conductive blade pair whereby when the control button is moved to the ON position, the seesaws are simultaneously driven to the engaged position by the driver assemblies.

18. The switch as claimed in claim 17, wherein each driver assembly comprises a movable cap supported by a biasing element whereby the cap is biased to engage the associated seesaw plate whereby when the control button is moved between the ON and OFF positions, the cap is moved between opposite ends of the seesaw plate with respect to the rotatable support of the seesaw plate in the casing thereby seesawing the seesaw plate between the engaged and disengaged positions.

19. The switch as claimed in claim 18, wherein the biasing element comprises a helical spring having an end attached to the cap.

20. The switch as claimed in claim 19, wherein the driver assembly further comprises a cylinder extending from an underside of the control button to receive and retain an opposite end of the helical spring.

* * * * *